US007893376B2

(12) United States Patent
Chen

(10) Patent No.: US 7,893,376 B2
(45) Date of Patent: Feb. 22, 2011

(54) KEY STRUCTURE WITH SCISSORS-TYPE CONNECTING MEMBER

(75) Inventor: Ching-Hsiang Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 50 days.

(21) Appl. No.: 12/506,898

(22) Filed: Jul. 21, 2009

(65) Prior Publication Data

US 2010/0307902 A1 Dec. 9, 2010

(30) Foreign Application Priority Data

Jun. 5, 2009 (TW) ..... 98118697 A

(51) Int. Cl.
*H01H 13/70* (2006.01)

(52) U.S. Cl. ..... 200/344

(58) Field of Classification Search ..... 200/344, 200/345, 5 A, 517; 400/490, 496, 480, 492, 400/495

See application file for complete search history.

(56) References Cited

U.S. PATENT DOCUMENTS 6,550,993 B2 * 4/2003 Lu et al. ..... 400/490
6,642,466 B1 * 11/2003 Lu ..... 200/344
6,706,986 B2 * 3/2004 Hsu ..... 200/344
6,733,196 B2 * 5/2004 Lee et al. ..... 400/480

* cited by examiner

*Primary Examiner*—Edwin A. Leon
(74) *Attorney, Agent, or Firm*—Kirton & McConkie; Evan R. Witt

(57) ABSTRACT

A key structure includes a scissors-type connecting member. The scissors-type connecting member includes a first frame and a second frame. The first frame includes a first protrusion and a second protrusion. The second frame includes a first receiving recess for accommodating the first protrusion, a second receiving recess for accommodating the second protrusion, and a partition wall between the first receiving recess and the second receiving recess. When the first frame is swung with respect to the second frame, the first protrusion is sustained against a first side of the partition wall and moved on the first side of the partition wall, and the second protrusion is sustained against a second side of the partition wall and moved on the second side of the partition wall. Consequently, the first protrusion and the second protrusion are permitted to be partially detached from first receiving recess and the second receiving recess, respectively.

10 Claims, 9 Drawing Sheets

KEY STRUCTURE WITH SCISSORS-TYPE CONNECTING MEMBER

FIELD OF THE INVENTION

The present invention relates to a key structure, and more particularly to a key structure for use in a computer keyboard.

BACKGROUND OF THE INVENTION

With rapid development of electronic and information industries, computers and the peripheral device thereof become essential parts in our daily lives. In addition to the working purposes, computers can be employed as amusement tools. In the computer systems, input devices play important roles for communicating the computer and the user. The common input devices of the computer systems are for examples keyboards. For helping the user well operate the computer, many novel keyboards are developed in views of humanization and user-friendliness.

Generally, a keyboard has a plurality of key structures. FIG. 1 is a schematic exploded view illustrating a key structure of a keyboard according to the prior art. As shown in FIG. 1, the key structure 1 comprises a keycap 11, a scissors-type connecting member 12, an elastic element 13, a membrane switch 14 and a base plate 15. The keycap 11 could be depressed by a user. The keycap 11 is connected with the scissors-type connecting member 12. The scissors-type connecting member 12 comprises an inner frame 121 and an outer frame 122. The scissors-type connecting member 12 is connected with the keycap 11 and the base plate 15. The inner frame 121 has two inner frame pivot rods 1211. Corresponding to the inner frame pivot rods 1211, two outer frame pivot holes 1221 are formed in the outer frame 122. The inner frame pivot rods 1211 are pivotally coupled with the outer frame pivot holes 1221 such that the inner frame 121 is rotatable with respect to the outer frame 122. The membrane switch 14 is arranged on the base plate 15. The elastic element 13 is arranged between the keycap 11 and the membrane switch 14. When the keycap 11 is depressed, the elastic element 13 is deformed downwardly to trigger the membrane switch 14 such that the membrane switch 14 generates an electronic signal. After these components 11, 12, 13 and 14 are combined together, a resulting configuration of the key structure 1 is shown in FIG. 2.

In a case that the keycap 11 is not depressed, the keycap 11 is located at a first height. Whereas, when the keycap 11 is depressed, a depressing force is exerted on the keycap 11 and the elastic element 13 is compressed in response to the depressing force. As the keycap 11 is depressed, the inner frame 121 and the outer frame 122 of the scissors-type connecting member 12 are rotated such that the inner frame 121 and the outer frame 122 are parallel with each other. At the same time, the membrane switch 14 on the base plate 15 is triggered to generate an electronic signal. In addition, the keycap 11 is lowered from the first height to a second height. The difference between the first height and the second height indicates the travel distance of the key structure 1.

In a case that the depressing force exerted on the keycap 11 is eliminated, the keycap 11 will be moved upwardly due to the restoring force of the elastic element 13. As the keycap 11 is moved upwardly, the inner frame 121 and the outer frame 122 are transmitted by the keycap 11 to rotate. As such, the keycap 11 is returned to its original position at the first height. In designing the scissors-type connecting member 12, the keycap 11 needs to be returned to its original position after the depressing force exerted on the keycap 11 is eliminated.

Generally, the elastic element 13 provides the restoring force to push the keycap 11 back to its original position. Moreover, the inner frame 121 and the outer frame 122 need to cooperate with each other in order to precisely control the upward moving action of the keycap 11. In other words, the configurations of the inner frame 121 and the outer frame 122 are very important factors that influence the quality and the use life of the key structure 1.

For combining the inner frame 121 with the outer frame 122, the user needs to prop open the outer frame 122 to widen the distance between the two outer frame pivot holes 1221, which are formed in bilateral sides of the outer frame 122. As such, the inner frame pivot rods 1211 could be successfully inserted into corresponding outer frame pivot holes 1221 so as to combine the inner frame 121 and the outer frame 122 together. The procedure of propping-open the outer frame 122 increases the assembling time of the key structure 1 and is detrimental to the throughput of the keyboard. On the other hand, if the external force used to prop open the outer frame 122 is improper, the outer frame 122 is readily damaged or distorted. Under this circumstance, the yield is reduced and the fabricating cost is increased. Moreover, since the outer frame 122 has the outer frame pivot holes 1221, the outer frame 122 becomes weak and is easily damaged. In other words, the scissors-type connecting member 12 is not suitable for slimness of the key structure 1.

Therefore, there is a need of providing an improved key structure with a scissors-type connecting member so as to obviate the drawbacks encountered from the prior art.

SUMMARY OF THE INVENTION

It is an object of the present invention to provide a key structure whose scissors-type connecting member is not easily damaged.

Another object of the present invention provides a key structure whose scissors-type connecting member is easily assembled without the need of propping open the outer frame.

In accordance with an aspect of the present invention, there is provided a key structure with a scissors-type connecting member. The key structure includes a base plate, a keycap and the scissors-type connecting member. The scissors-type connecting member is arranged between the base plate and the keycap for connecting the base plate with the keycap such that the keycap is moved upwardly or upwardly with respect to the base plate. The scissors-type connecting member includes a first frame and a second frame. The first frame includes a first protrusion and a second protrusion. The second frame is connected with the first frame. The second frame includes a first receiving recess for accommodating the first protrusion, a second receiving recess for accommodating the second protrusion, and a partition wall arranged between the first receiving recess and the second receiving recess and contacted with the first protrusion and the second protrusion. When the first frame is swung with respect to the second frame, the first protrusion is sustained against a first side of the partition wall and moved on the first side of the partition wall, and the second protrusion is sustained against a second side of the partition wall and moved on the second side of the partition wall.

In an embodiment, the key structure further includes a membrane switch arranged on the base plate and under the scissors-type connecting member. The membrane switch is triggered to generate an electronic signal.

In an embodiment, the key structure further includes an elastic element arranged between the membrane switch and the keycap. When the keycap is depressed to exert a depressing force on the keycap, the elastic element is compressed and sustained against the membrane switch such that the membrane switch is triggered to generate the electronic signal. Whereas, when the depressing force exerted on the keycap is eliminated, a restoring force offered by the elastic element is applied on the keycap such that the keycap is returned to an original position.

In an embodiment, the first frame has an opening in a center thereof, and the elastic element penetrates through the opening and is contacted with the keycap.

In an embodiment, the elastic element is an elastic rubber.

In an embodiment, the base plate further includes a base plate fixing recess and a base plate gliding recess. The base plate fixing recess is connected with a first end of the second frame for fixing the second frame on the base plate. The base plate gliding recess is connected with a first end of the first frame, so that the first end of the first frame is allowed to glide along the base plate gliding recess.

In an embodiment, the keycap further includes a keycap fixing recess and a keycap gliding recess. The keycap fixing recess is connected with a second end of the first frame for fixing the first frame on the keycap. The keycap gliding recess is connected with a second end of the second frame, so that the second end of the second frame is allowed to glide along the keycap gliding recess while the first end of the first frame glides along the base plate gliding recess.

In an embodiment, when the keycap is not depressed, the keycap is located at a first height, the first protrusion is partially inserted within the first receiving recess and the second protrusion is partially inserted within the second receiving recess. Whereas, when the keycap is depressed, the keycap is located at a second height, the first protrusion is completely inserted into the first receiving recess and the second protrusion is completely inserted into the second receiving recess.

In an embodiment, the first frame is an inner frame, the second frame is an outer frame, and the first frame is mounted in an inner portion of the second frame.

In an embodiment, the first frame is an outer frame, the second frame is an inner frame, and the second frame is mounted in an inner portion of the first frame.

In accordance with another aspect of the present invention, there is provided a method of assembling a scissors-type connecting member. The scissors-type connecting member includes a first frame and second frame. The first frame includes a first protrusion and a second protrusion. The second frame includes a first receiving recess, a second receiving recess and a fastening part. The method includes the following steps. Firstly, the first frame is placed on the second frame such that the first frame is aligned with the second frame, wherein the first protrusion is contacted with the first receiving recess, and the second protrusion is contacted with the second receiving recess. Then, an external force is exerted on the first frame. In response to the external force, the first protrusion is accommodated within the first receiving recess, and the second protrusion is moved on the fastening part and then accommodated within the second receiving recess.

In an embodiment, the method further includes a step of providing an assembly mold, wherein the assembly mold comprises a first half mold with a first mold cavity and a second half mold with a second mold cavity, and the second half mold is rotatable with respect to the first half mold.

In an embodiment, the first half mold is coupled with the second half mold through a hinge.

In an embodiment, the method further includes steps of placing the second frame in the first mold cavity of the first half mold, placing the first frame in the second mold cavity of the second half mold, and rotating the second half mold such that the first half mold is covered by the second half mold and the first frame is placed on and aligned with the second frame.

In an embodiment, when the first half mold is covered by the second half mold, a downward force offered by the second half mold is exerted on the first frame such that the second protrusion is moved on the fastening part and then accommodated within the second receiving recess.

In an embodiment, the method further includes a step of providing an assembly mold. The assembly mold includes a mold cavity and a positioning post. The positioning post is arranged in a middle portion of the mold cavity. The second frame is placed in the mold cavity of the assembly mold and encloses the positioning post.

In an embodiment, the first frame further comprises an opening. The positioning post penetrates through the opening of the first frame such that the first frame is placed on the second frame. The first frame is engaged with the positioning post such that the first frame is fixed at a position where the first frame is aligned with the second frame.

In an embodiment, the positioning post is elastically connected with the mold cavity. The first frame is moved downwardly to be connected with the second frame in response to the external force exerted on the first frame.

In an embodiment, the method further includes a step of providing an assembly mold. The assembly mold includes a mold cavity and a positioning post. The positioning post is arranged in a middle portion of the mold cavity.

In an embodiment, the second frame further comprises an opening. The positioning post penetrates through the opening of the second frame such that the second frame is fixed on the positioning post. The first frame is placed in the mold cavity of the assembly mold such that the first frame is aligned with the second frame. The first frame is moved downwardly to be connected with the second frame in response to the external force exerted on the first frame.

In an embodiment, each of the first frame and the second frame is produced by an injection molding process.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
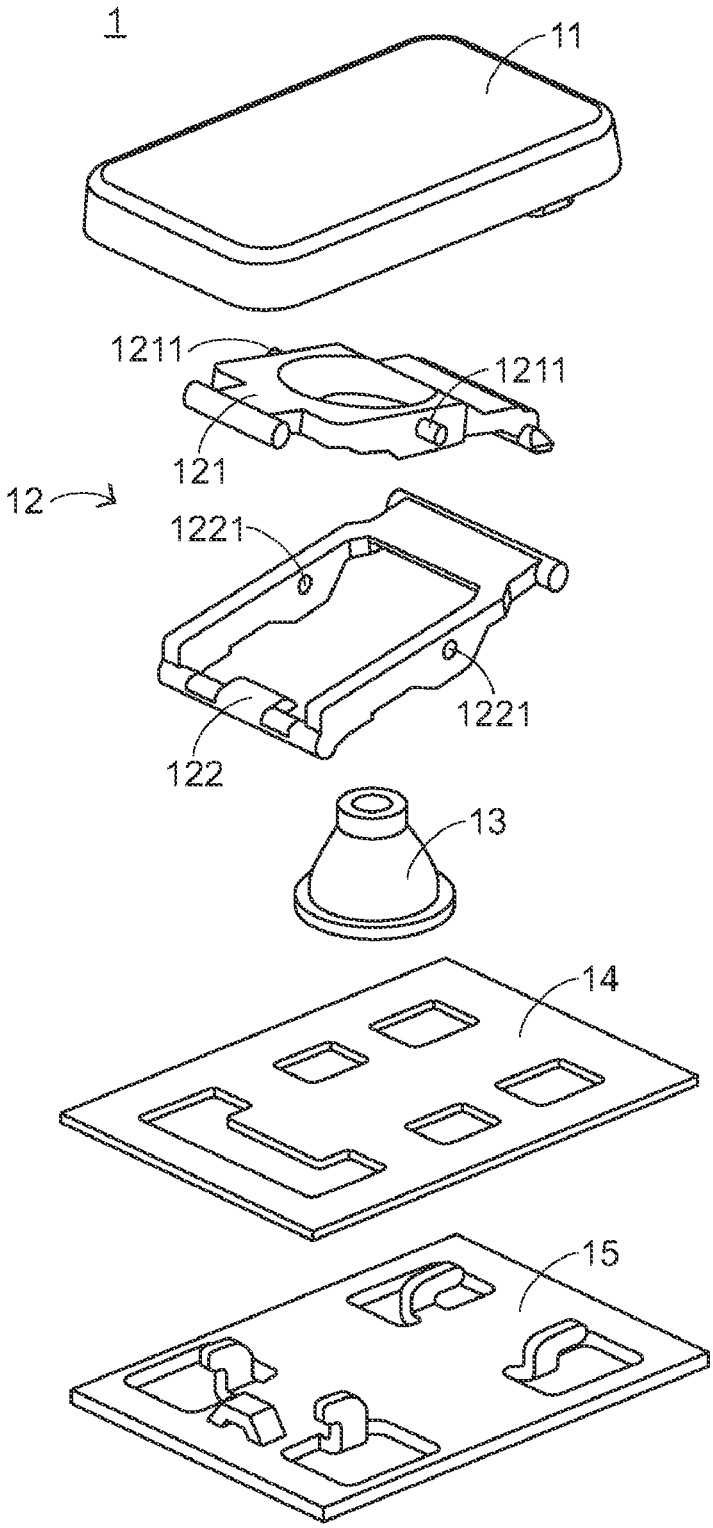
FIG.1 PRIOR ART
FIG. 1 is a schematic exploded view illustrating a key structure of a keyboard according to the prior art.
Figure 2:
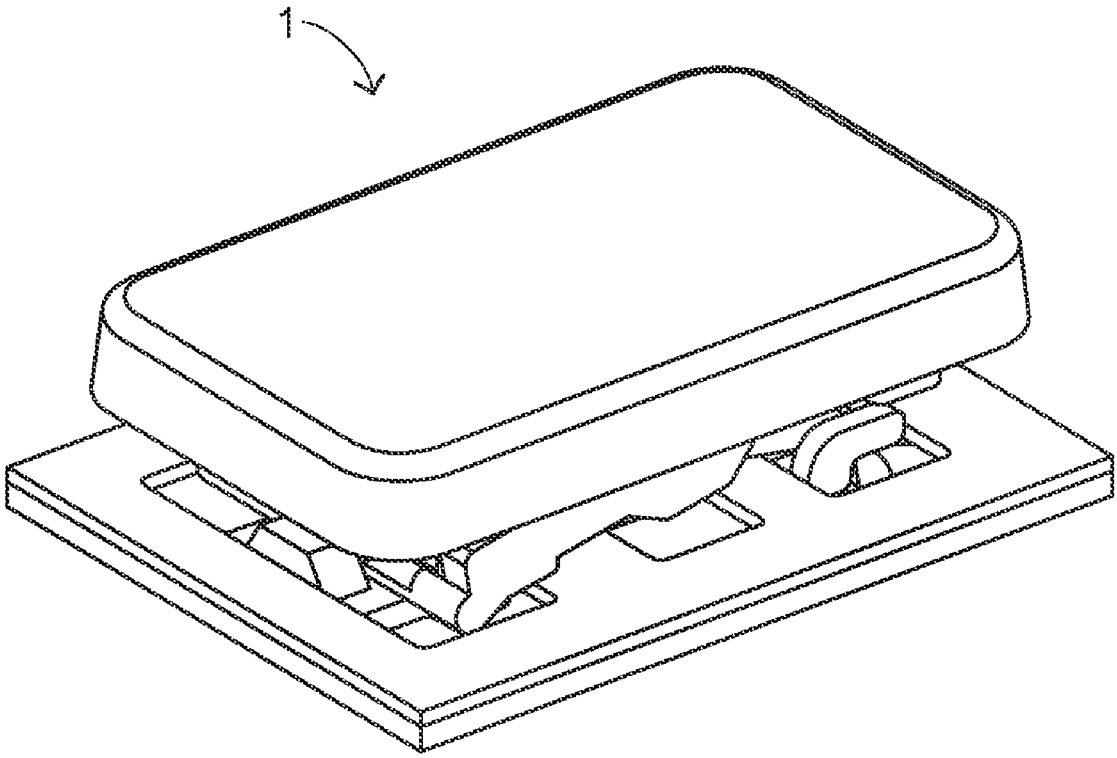
FIG.2 PRIOR ART
FIG. 2 is a schematic assembled view illustrating the key structure as shown in FIG. 1.
Figure 3:
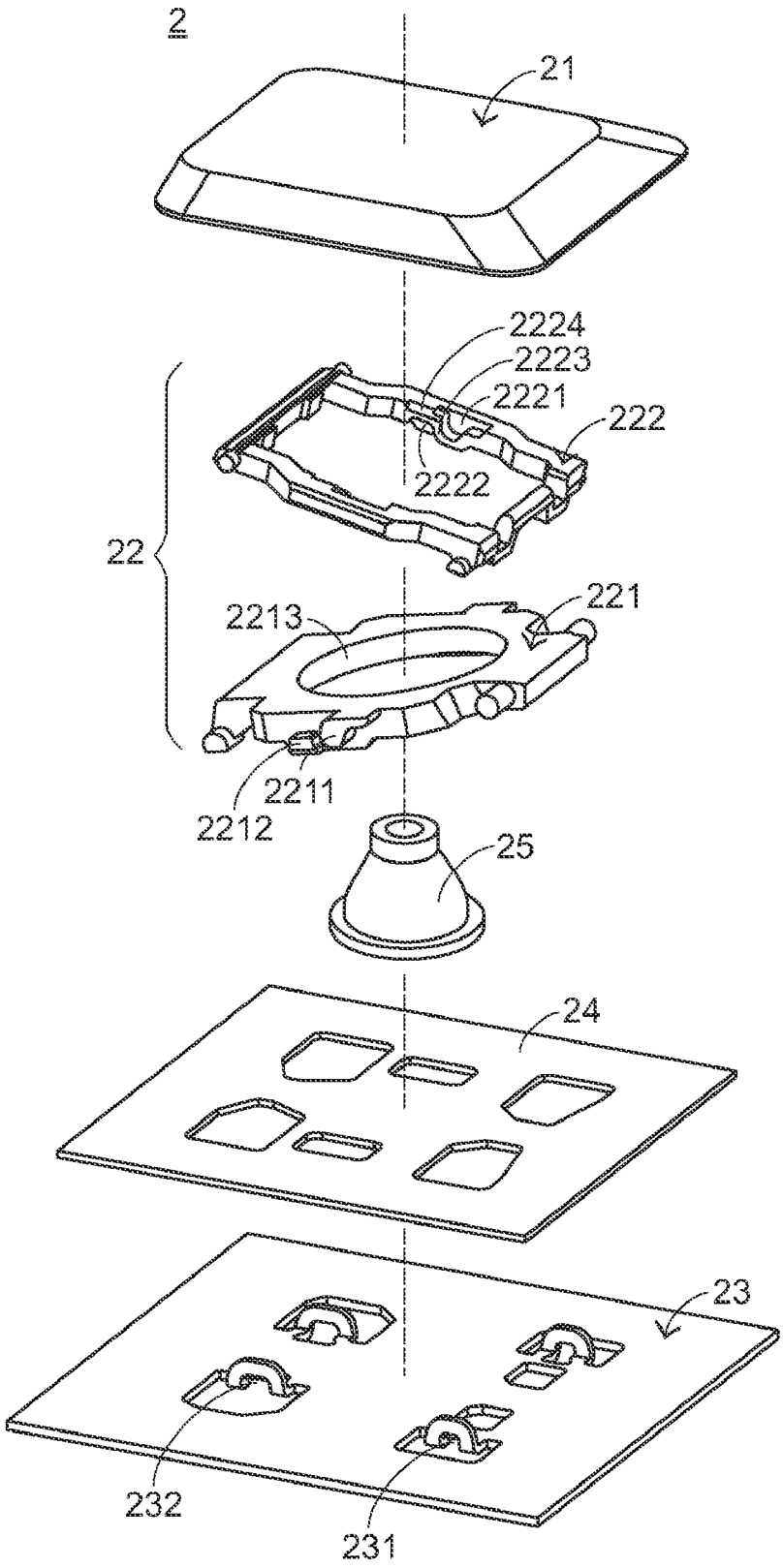
FIG. 3 is a schematic exploded view illustrating a key structure with a scissors-type connecting member according to an embodiment of the present invention.

FIG. 3 is a schematic exploded view illustrating a key structure with a scissors-type connecting member according to an embodiment of the present invention. As shown in FIG. 3, the key structure 2 comprises a keycap 21, a scissors-type connecting member 22, a base plate 23, a membrane switch 24 and an elastic element 25. The scissors-type connecting member 22 is arranged between the base plate 23 and the keycap 21. The scissors-type connecting member 22 is connected with the base plate 23 and the keycap 21 such that the keycap 21 is permitted to move upwardly or downwardly with respect to the base plate 23. The scissors-type connecting member 22 comprises a first frame 221 and a second frame 222. The membrane switch 24 is arranged on the base plate 23. The elastic element 25 is arranged between the keycap 21 and the membrane switch 24. When the keycap 21 is depressed, the membrane switch 24 is triggered by the elastic element 25 so as to generate an electronic signal. An example of the elastic element 25 is an elastic rubber.

Figure 4:
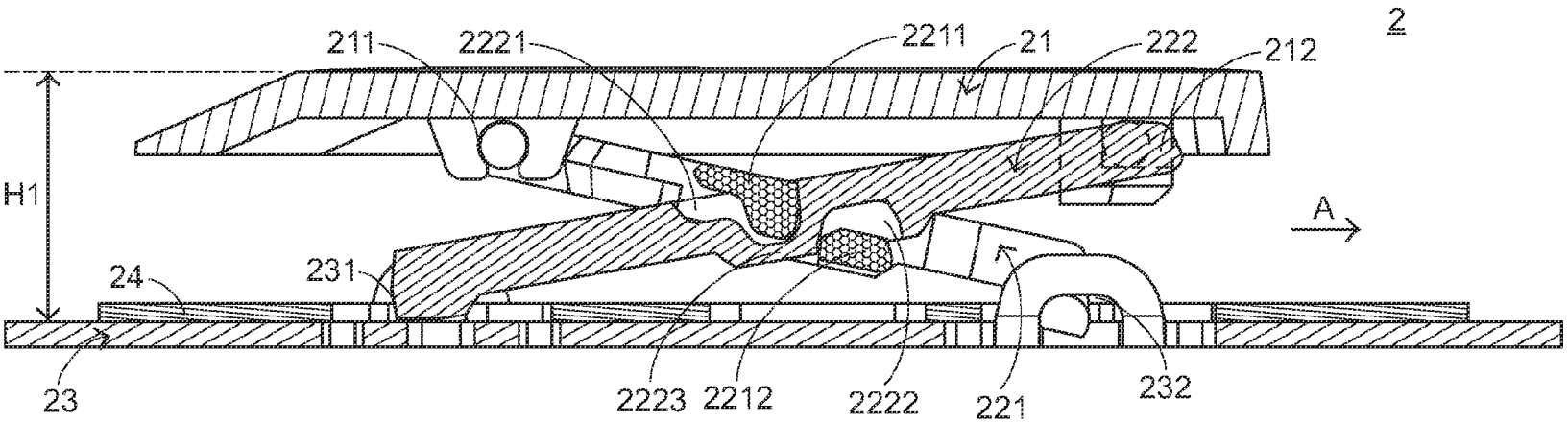
FIG. 4 is a schematic cross-sectional view illustrating the key structure of the present invention that is not depressed.

Please refer to FIG. 3 again. The first frame 221 comprises a first protrusion 2211, a second protrusion 2212 and an opening 2213. The second frame 222 is connected with the first frame 221. The second frame 222 comprises a first receiving recess 2221, a second receiving recess 2222, a partition wall 2223 and a fastening part 2224. The first receiving recess 2221 is used for accommodating the first protrusion 2211. The second receiving recess 2222 is used for accommodating the second protrusion 2212. The partition wall 2223 is arranged between the first protrusion 2211 and the second protrusion 2212, and contacted with the first protrusion 2211 and the second protrusion 2212. After the first frame 221 and the second frame 222 are combined together, the resulting configuration of the key structure 2 is shown in FIG. 4. Moreover, after the second protrusion 2212 is accommodated within the second receiving recess 2222, the second protrusion 2212 is fastened by the fastening part 2224. In other words, the second protrusion 2212 is hindered by the fastening part 2224, so that the second protrusion 2212 is only permitted to be detached from the second receiving recess 2222 in an opposite direction.

FIG. 4 is a schematic cross-sectional view illustrating the key structure of the present invention that is not depressed. The base plate 23 comprises a base plate fixing recess 231 and a base plate gliding recess 232. The base plate fixing recess 231 is connected with a first end of the second frame 222 so as to fix the second frame 222 on the base plate 23. The base plate gliding recess 232 is connected with a first end of the first frame 221, so that the first frame 221 is allowed to glide along the base plate gliding recess 232. The keycap 21 comprises a keycap fixing recess 211 and a keycap gliding recess 212. The keycap fixing recess 211 is connected with a second end of the first frame 221 so as to fix the first frame 221 on the keycap 21. The keycap gliding recess 212 is connected with a second end of the second frame 222, so that the second frame 222 is allowed to glide along the keycap gliding recess 212 while the first frame 221 glides along the base plate gliding recess 232. In this embodiment, the first frame 221 and the second frame 222 are also referred as an inner frame and an outer frame, respectively.

In a case that the keycap 21 is not depressed, the keycap 21 is located at a first height H1 with respect to the base plate 26. Meanwhile, the first protrusion 2211 is partially inserted within the first receiving recess 2221, and the second protrusion 2212 is partially inserted within the second receiving recess 2222. Whereas, when the keycap 21 is depressed, a depressing force is exerted on the keycap 21 and the elastic element 25 is compressed in response to the depressing force. As the keycap 21 is moved downwardly, the first frame 221 and the second frame 222 are correspondingly rotated. As shown in FIG. 4, the second end of the second frame 222, which is accommodated within the keycap gliding recess 212, is moved in a first direction A. At the same time, the first end of the first frame 221, which is accommodated within the base plate gliding recess 232, is also moved in the first direction A. As such, the first protrusion 2211 of the first frame 221 is sustained against a first side of the partition wall 2223 of the second frame 222. The first protrusion 2211 is continuously moved on the first side of the partition wall 2223 and toward the first receiving recess 2221, and then the first protrusion 2211 is completely inserted into the first receiving recess 2221. Similarly, the second protrusion 2212 of the first frame 221 is sustained against a second side of the partition wall 2223 of the second frame 222. The second protrusion 2212 is continuously moved on the second side of the partition wall 2223 and toward the second receiving recess 2222, and then the second protrusion 2212 is completely inserted into the second receiving recess 2222. After the keycap 21 has been completely depressed, the first frame 221 and the second frame 222 are parallel with each other, and the keycap 21 is located at a second height H2 with respect to the base plate 23 (see FIG. 5). At the same time, the membrane switch 24 on the base plate 23 is triggered by the elastic element 25, thereby generating an electronic signal.

Figure 5:
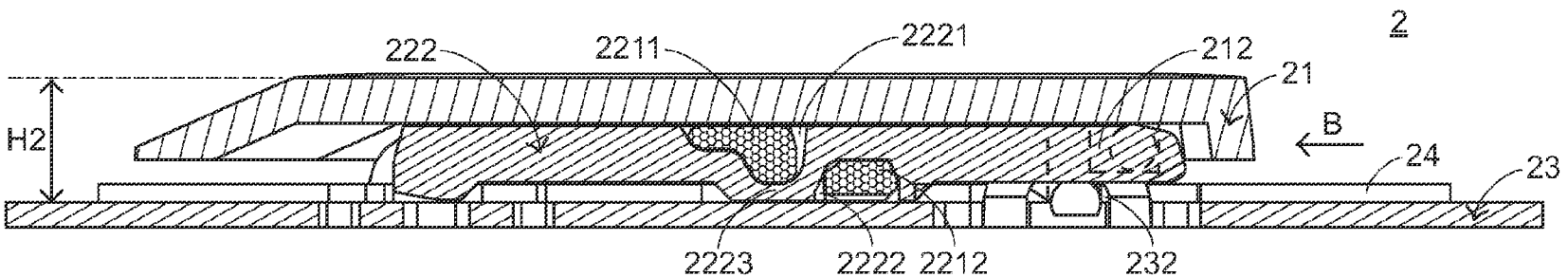
FIG. 5 is a schematic cross-sectional view illustrating the key structure of the present invention that has been depressed.

After the depressing force exerted on the keycap 21 is eliminated, the elastic element 25 in the compressed state generates a restoring force. The restoring force will push the keycap 21 to move upwardly. As the keycap 21 is moved upwardly, the first frame 221 and the second frame 222 are correspondingly rotated. As shown in FIG. 5, the second end of the second frame 222, which is accommodated within the keycap gliding recess 212, is moved in a second direction B. At the same time, the first end of the first frame 221, which is accommodated within the base plate gliding recess 232, is also moved in the second direction B. As such, the first protrusion 2211 of the first frame 221 is partially detached from first receiving recess 2221, and the second protrusion 2221 of the second frame 222 is partially detached from second receiving recess 2222. Meanwhile, the keycap 21 is returned to its original position where the keycap 21 is located at the first height H1 (see FIG. 4).

Figure 6:
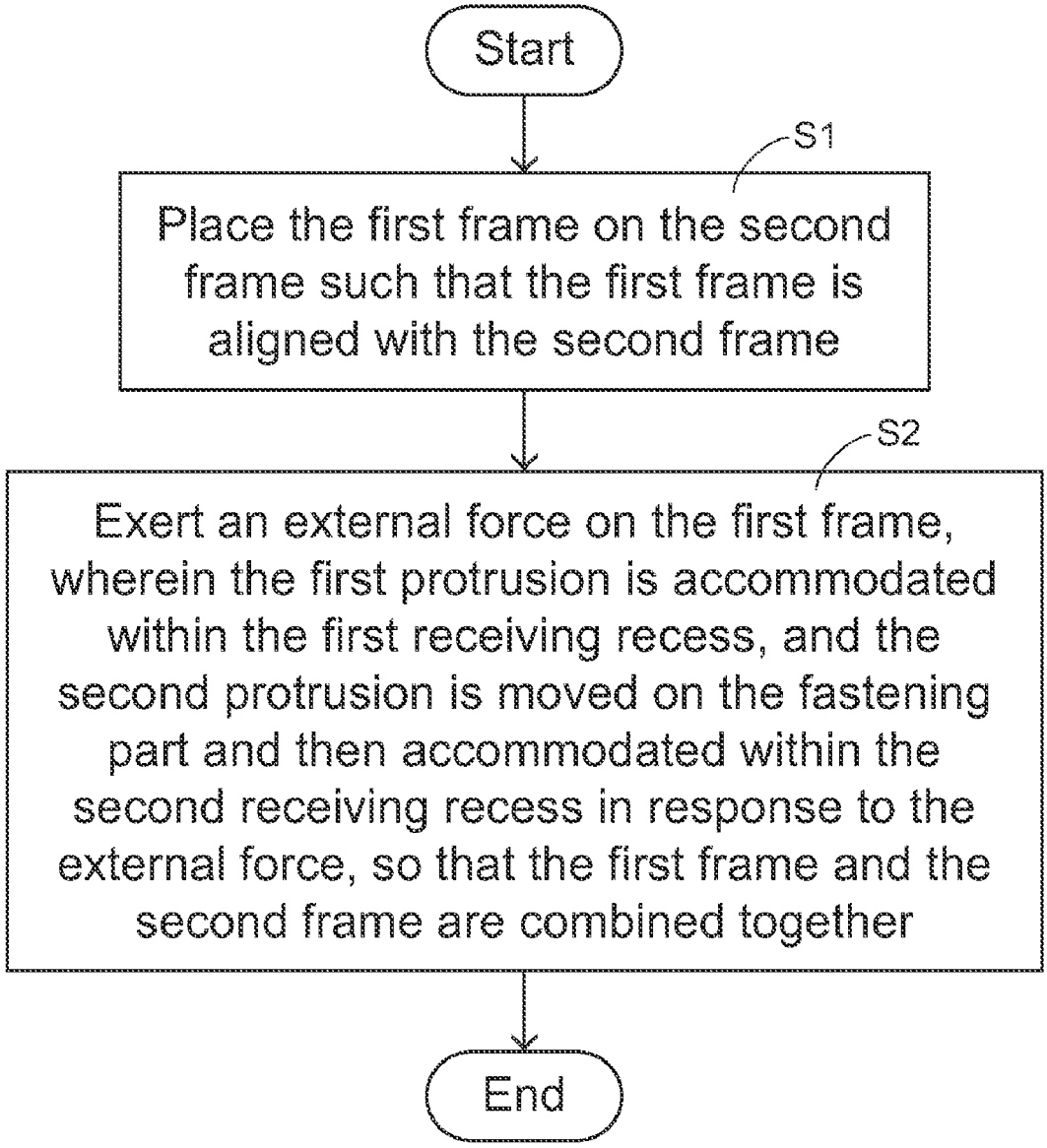
FIG. 6 is a flowchart illustrating a process of assembling the scissors-type connecting member of the key structure according to an embodiment of the present invention.

Since the scissors-type connecting member 22 has no inner frame pivot rods and no outer frame pivot holes, the key structure 2 of the present invention is stronger when compared with the prior art. In particular, the process of assembling the scissors-type connecting member 22 of the present invention is simplified. FIG. 6 is a flowchart illustrating a process of assembling the scissors-type connecting member of the key structure according to an embodiment of the present invention. First of all, the first frame is placed on the second frame such that the first frame is aligned with the second frame (Step S1). Then, an external force is exerted on the first frame. In response to the external force, the first protrusion is accommodated within the first receiving recess, and the second protrusion is moved on the fastening part and then accommodated within the second receiving recess. Consequently, the first frame and the second frame are combined together (Step S2). In an embodiment, each of the first frame 221 and the second frame 222 is produced by an injection molding process.

Figure 7A:
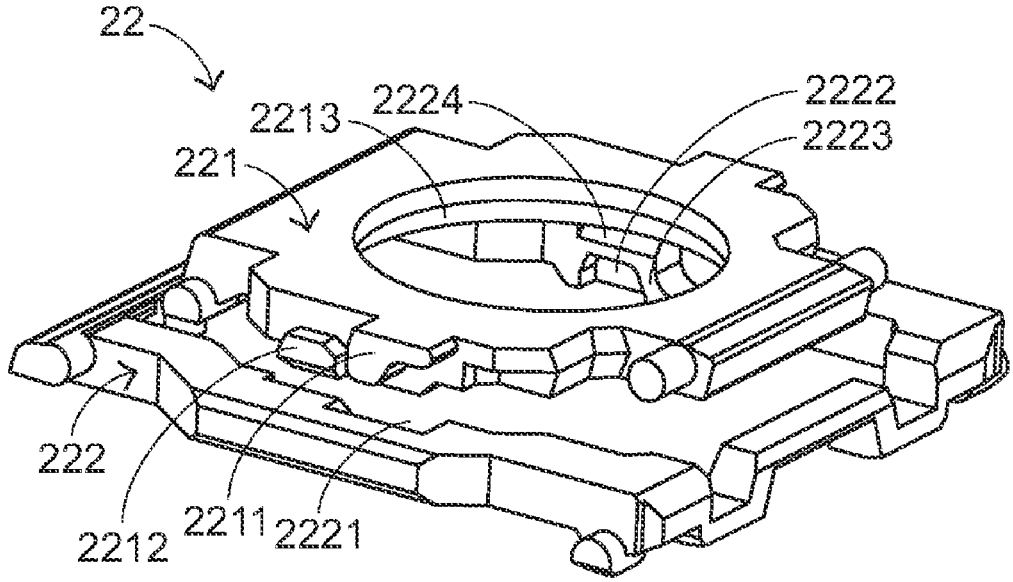
FIGS. 7A and 7B are schematic views illustrating a process of assembling the scissors-type connecting member of the key structure according to an embodiment of the present invention.
Figure 7B:
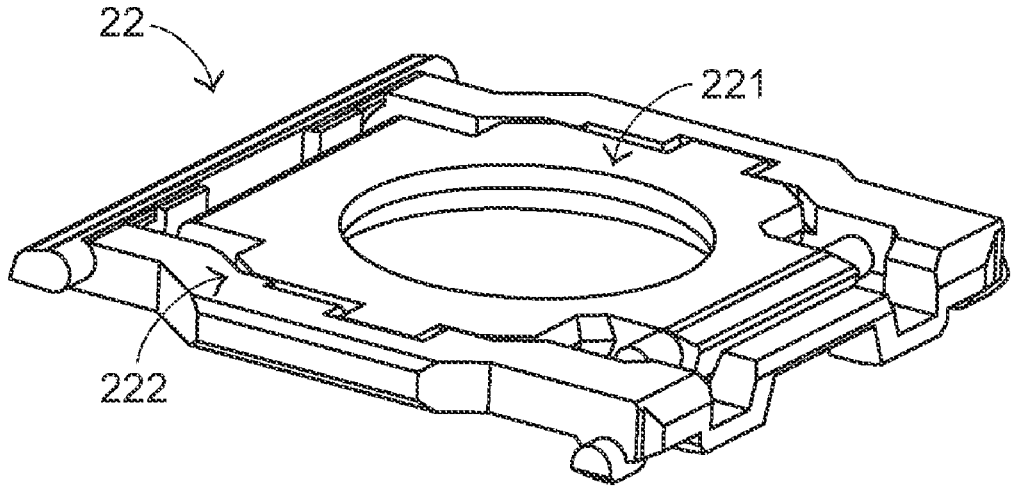

FIGS. 7A and 7B are schematic views illustrating a process of assembling the scissors-type connecting member of the key structure according to an embodiment of the present invention. As shown in FIG. 7A, the first frame 221 is placed on the second frame 222, and the first frame 221 is aligned with the second frame 222. As shown in FIG. 7B, an external force is exerted on the first frame such that the first frame 221 and the second frame 222 are combined together, wherein the first protrusion 2211 is accommodated within the first receiving recess 2221, and the second protrusion 2212 is moved on the fastening part 2224 and then accommodated within the second receiving recess 2222. In this embodiment, the scissors-type connecting member 22 is manually assembled. As the key structure become slim, the process of manually assembling the scissors-type connecting member 22 becomes troublesome and inefficient. In some embodiments, the use of an assembly mold could facilitate assembling the slim scissors-type connecting member 22 in order to enhancing the assembling efficiency.

Figure 8A:
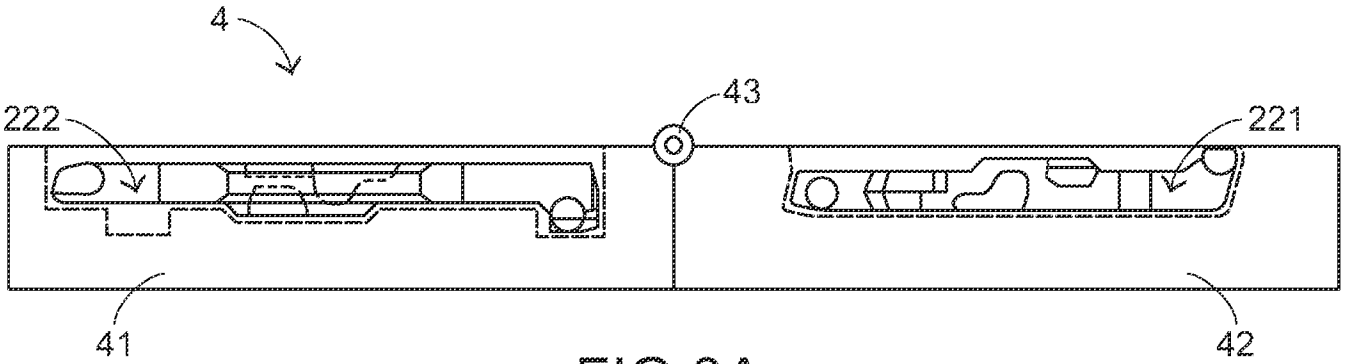
FIGS. 8A and 8B are schematic side views illustrating the use of a first assembly mold to assemble the scissors-type connecting member of the key structure according to an embodiment of the present invention.
Figure 8B:
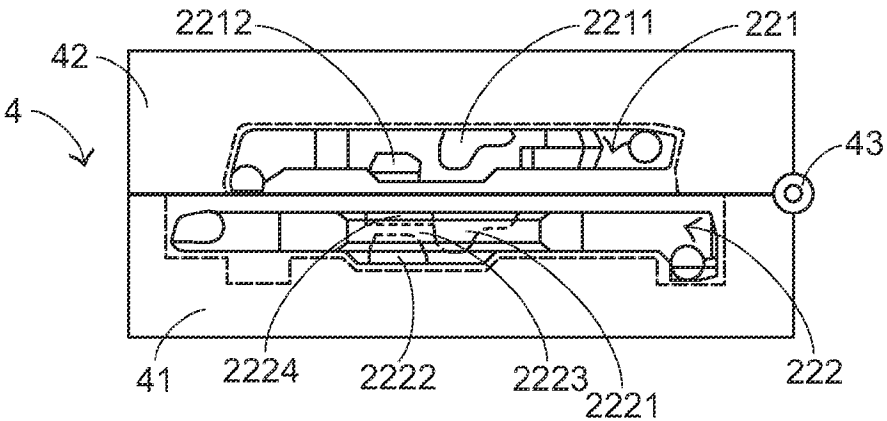

FIGS. 8A and 8B are schematic side views illustrating the use of a first assembly mold to assemble the scissors-type connecting member of the key structure according to an embodiment of the present invention. As shown in FIG. 8A, a first assembly mold 4 is provided. The first assembly mold 4 comprises a first half mold 41 with a first mold cavity, a second half mold 42 with a second mold cavity, and a hinge 43. The first half mold 41 and the second half mold 42 are pivotally coupled with each other through the hinge 43. In other words, the second half mold 42 is rotatable with respect to the first half mold 41. Each of the first frame 221 and the second frame 222 is produced by an injection molding process. For assembling the scissors-type connecting member 22, after the second frame 222 is placed in the first mold cavity of the first half mold 41 and the first frame 221 is placed in the second mold cavity of the second half mold 42, the second half mold 42 is rotated to be disposed on the first half mold 41 such that the first half mold 41 is covered by the second half mold 42 (see FIG. 8B). Under this circumstance, the first frame 221 is placed on the second frame 222 and aligned with the second frame 222.

During the first half mold 41 is covered by the second half mold 42, a downward force offered by the second half mold 42 is exerted on the first frame 221. In response to the downward force, the first protrusion 2211 is accommodated within the first receiving recess 2221, and the second protrusion 2212 is moved on the fastening part 2224 and then accommodated within the second receiving recess 2222. As a consequence, the first frame 221 and the second frame 222 are combined together. After the first frame 221 and the second frame 222 are combined together, the second half mold 42 is opened and then the combination of the first frame 221 and the second frame 222 is removed from the first assembly mold 4. Meanwhile, the process of assembling the scissors-type connecting member 22 by using the first assembly mold 4 is completed.

Figure 9A:
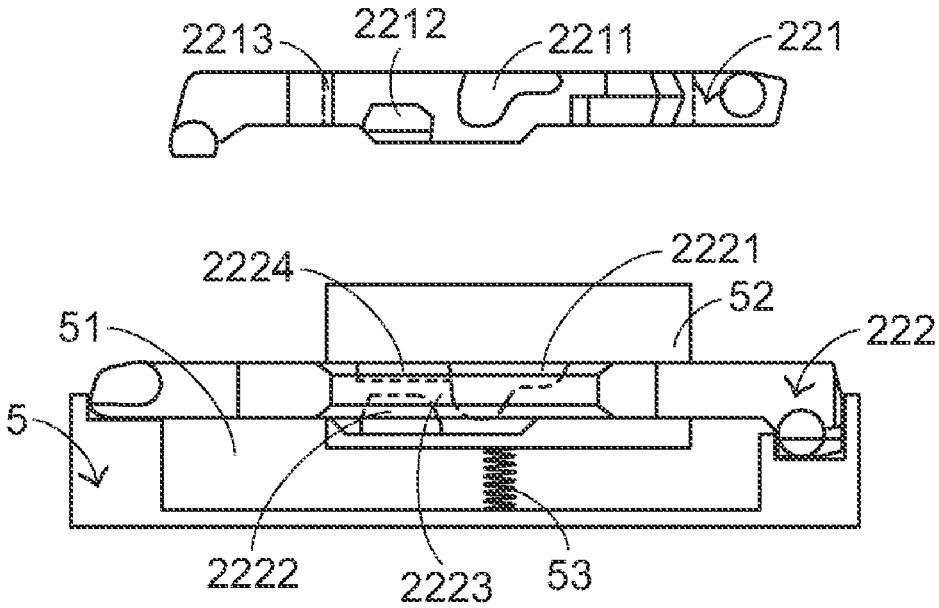
FIGS. 9A and 9B are schematic side views illustrating the use of a second assembly mold to assemble the scissors-type connecting member of the key structure according to an embodiment of the present invention.
Figure 9B:
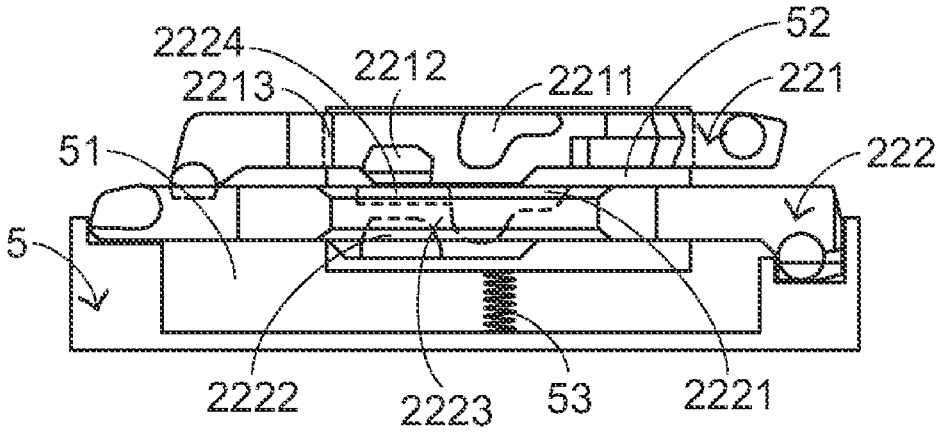

It is noted that the scissors-type connecting member of the present invention could be assembled by other assembly mold. FIGS. 9A and 9B are schematic side views illustrating the use of a second assembly mold to assemble the scissors-type connecting member of the key structure according to an embodiment of the present invention.

As shown in FIG. 9A, a second assembly mold 5 is provided. The second assembly mold 5 comprises a mold cavity 51 and a positioning post 52. The positioning post 52 is arranged in the middle portion of the mold cavity 51. In addition, the positioning post 52 is elastically connected with the mold cavity 51. As shown in FIG. 9A, the positioning post 52 is connected with the mold cavity 51 via a spring 53. The process of assembling the scissors-type connecting member 22 by using the second assembly mold 5 will be illustrated as follows. First of all, the second frame 222 is placed in the mold cavity 51 of the second assembly mold 5, wherein the second frame 222 encloses the positioning post 52. Then, the positioning post 52 penetrates through the opening 2213 of the first frame 221 such that the first frame 221 is placed on the second frame 222. At the same time, the first frame 221 is engaged with the positioning post 52, so that the first frame 221 is fixed at a position where the first frame 221 is aligned with the second frame 222 (see FIG. 9B). Then, a downward force is exerted on the first frame 221. In response to the downward force, the first protrusion 2211 is accommodated within the first receiving recess 2221, and the second protrusion 2212 is moved on the fastening part 2224 and then accommodated within the second receiving recess 2222. As a consequence, the first frame 221 and the second frame 222 are combined together. During the downward force is exerted on the first frame 221, the spring 53 that is connected with the positioning post 52 is compressed and the first frame 221 is moved downwardly to be connected with the second frame 222.

Figure 10:
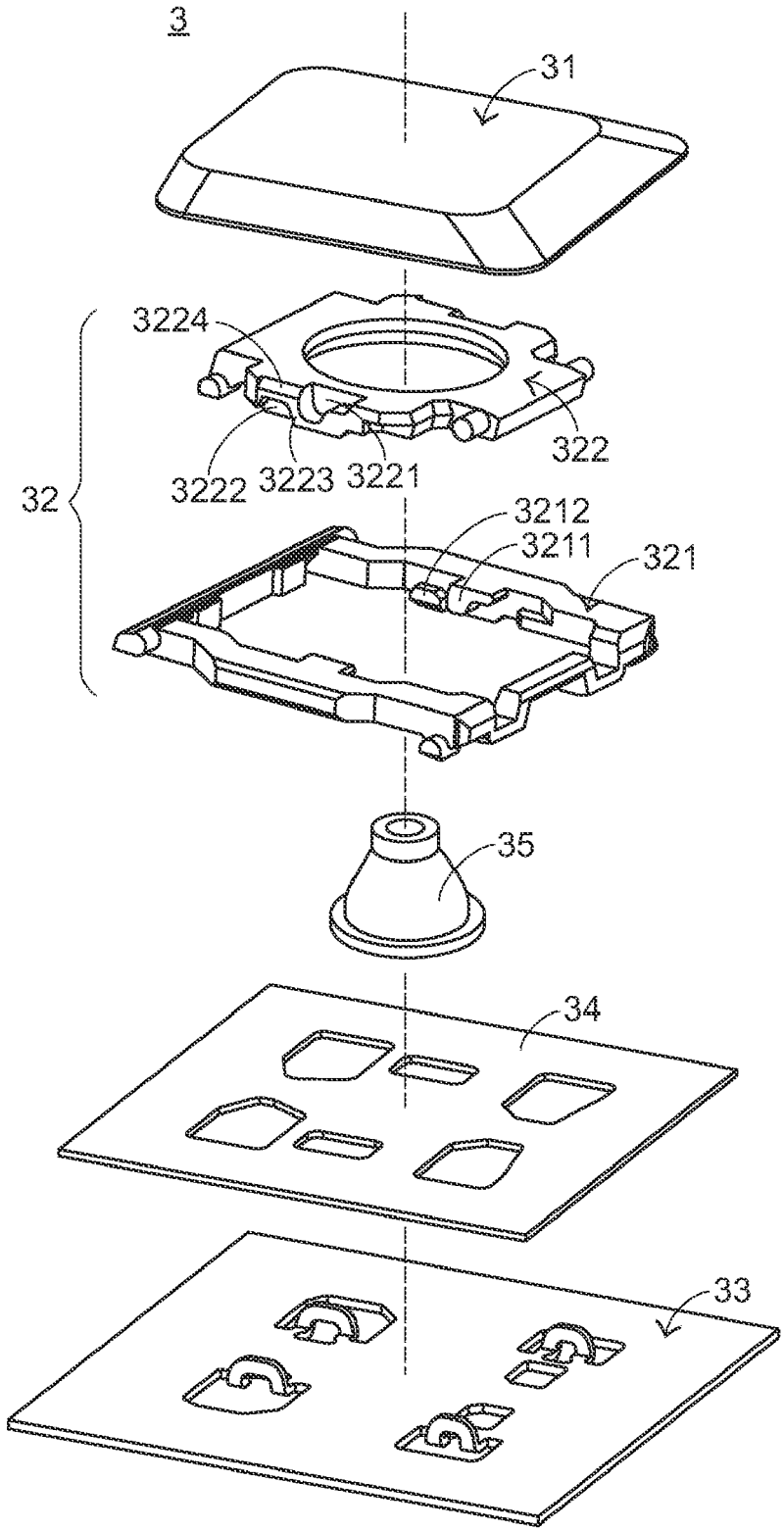
FIG. 10 is a schematic exploded view illustrating a key structure with a scissors-type connecting member according to another embodiment of the present invention.

As described in FIGS. 9 and 10, it is found that the uses of the first assembly mold 4 and the second assembly mold 5 to assemble the scissors-type connecting member 22 are feasible and user-friendly.

The present invention also provides another key structure with a scissors-type connecting member. FIG. 10 is a schematic exploded view illustrating a key structure with a scissors-type connecting member according to another embodiment of the present invention. As shown in FIG. 10, the key structure 3 comprises a keycap 31, a scissors-type connecting member 32, a base plate 33, a membrane switch 34 and an elastic element 35. The first frame 321 comprises a first protrusion 3211 and a second protrusion 3212. The second frame 322 is connected with the first frame 321. The second frame 322 comprises a first receiving recess 3221, a second receiving recess 3222, a partition wall 3223 and a fastening part 3224. The first receiving recess 3221 is used for accommodating the first protrusion 3211. The second receiving recess 3222 is used for accommodating the second protrusion 3212. The partition wall 3223 is arranged between the first protrusion 3211 and the second protrusion 3212, and contacted with the first protrusion 3211 and the second protrusion 3212. Moreover, after the second protrusion 3212 is accommodated within the second receiving recess 3222, the second protrusion 3212 is fastened by the fastening part 3224. In other words, the second protrusion 3212 is hindered by the fastening part 3224, so that the second protrusion 3212 is only permitted to be detached from the second receiving recess 3222 in an opposite direction. In this embodiment, the first frame 321 and the second frame 322 are also referred as an outer frame and an inner frame, respectively.

In a case that the keycap 31 is not depressed, the first protrusion 3211 is partially inserted within the first receiving recess 3221, and the second protrusion 3212 is partially inserted within the second receiving recess 3222. Whereas, when the keycap 31 is depressed, a depressing force is exerted on the keycap 31 and the keycap 31 is moved downwardly. As the keycap 31 is moved downwardly, the first frame 321 and the second frame 322 are correspondingly swung. At the same time, the first protrusion 3211 of the first frame 321 is sustained against a first side of the partition wall 3223 of the second frame 322. The first protrusion 3211 is continuously moved on the first side of the partition wall 3223 and toward the first receiving recess 3221, and then the first protrusion 3211 is completely inserted into the first receiving recess 3221. Similarly, the second protrusion 3212 of the first frame 321 is sustained against a second side of the partition wall 3223 of the second frame 322. The second protrusion 3212 is continuously moved on the second side of the partition wall 3223 and toward the second receiving recess 3222, and then the second protrusion 3212 is completely inserted into the second receiving recess 3222. After the keycap 31 has been completely depressed, the first frame 321 and the second frame 322 are parallel with each other. The operating principles of the other components of the key structure 3 are identical to those of key structure 2, and are not redundantly described herein.

In the above two embodiments, since the first protrusion and the second protrusion are sustained against the partition wall, the first frame and the second frame of the scissors-type connecting member of the key structure could be swung with respect to each other. Since the scissors-type connecting member of the present invention has no pivot rods and no pivot holes, the key structure of the present invention is stronger when compared with the prior art. In addition, the scissors-type connecting member of the present invention can achieve the same swinging function as the conventional scissors-type connecting member. On the other hand, the scissors-type connecting member of the present invention is simply assembled by aligning the first frame with the second frame and then applying an external force on the first frame or the second frame. Since the user needs not to prop open the outer frame and have the inner frame pivot rods insert into corresponding outer frame pivot holes during the process of assembling the scissors-type connecting member, the possibility of damaging the scissors-type connecting member is minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key structure with a scissors-type connecting member, said key structure comprising:

a base plate;

a keycap; and said scissors-type connecting member arranged between said base plate and said keycap for connecting said base plate with said keycap such that said keycap is moved upwardly or downwardly with respect to said base plate, said scissors-type connecting member comprising:

a first frame comprising a first protrusion and a second protrusion; and a second frame connected with said first frame, and comprising a first receiving recess for accommodating said first protrusion, a second receiving recess for accommodating said second protrusion, and a partition wall arranged between said first receiving recess and said second receiving recess and contacted with said first protrusion and said second protrusion, wherein when said first frame is swung with respect to said second frame, said first protrusion is sustained against a first side of said partition wall and moved on said first side of said partition wall, and said second protrusion is sustained against a second side of said partition wall and moved on said second side of said partition wall.

2. The key structure according to claim 1 further comprising a membrane switch arranged on said base plate and under said scissors-type connecting member, wherein said membrane switch is triggered to generate an electronic signal.

3. The key structure according to claim 2 further comprising an elastic element arranged between said membrane switch and said keycap, wherein when said keycap is depressed to exert a depressing force on said keycap, said elastic element is compressed and sustained against said membrane switch such that said membrane switch is triggered to generate said electronic signal, and when said depressing force exerted on said keycap is eliminated, a restoring force offered by said elastic element is applied on said keycap such that said keycap is returned to an original position.

4. The key structure according to claim 3 wherein said first frame has an opening in a center thereof, and said elastic element penetrates through said opening and is contacted with said keycap.

5. The key structure according to claim 3 wherein said elastic element is an elastic rubber.

6. The key structure according to claim 1 wherein said base plate further comprises:

a base plate fixing recess connected with a first end of said second frame for fixing said second frame on said base plate; and a base plate gliding recess connected with a first end of said first frame, so that said first end of said first frame is allowed to glide along said base plate gliding recess.

7. The key structure according to claim 6 wherein said keycap further comprises:

a keycap fixing recess connected with a second end of said first frame for fixing said first frame on said keycap; and a keycap gliding recess connected with a second end of said second frame, so that said second end of said second frame is allowed to glide along said keycap gliding recess while said first end of said first frame glides along said base plate gliding recess.

8. The key structure according to claim 1 wherein when said keycap is not depressed, said keycap is located at a first height, said first protrusion is partially inserted within said first receiving recess and said second protrusion is partially inserted within said second receiving recess; and when said keycap is depressed, said keycap is located at a second height, said first protrusion is completely inserted into said first receiving recess and said second protrusion is completely inserted into said second receiving recess.

9. The key structure according to claim 1 wherein said first frame is an inner frame, said second frame is an outer frame, and said first frame is mounted in an inner portion of said second frame.

10. The key structure according to claim 1 wherein said first frame is an outer frame, said second frame is an inner frame, and said second frame is mounted in an inner portion of said first frame.

* * * * *